US007714783B2

(12) United States Patent
Niu et al.

(10) Patent No.: US 7,714,783 B2
(45) Date of Patent: May 11, 2010

(54) METHOD AND SYSTEM FOR ANALOG BEAMFORMING IN WIRELESS COMMUNICATIONS

(75) Inventors: Huaning Niu, Sunnyvale, CA (US); Pengfei Xia, Mountain View, CA (US); Chiu Ngo, San Franciso, CA (US)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/890,207

(22) Filed: Aug. 2, 2007

(65) Prior Publication Data

US 2009/0033555 A1 Feb. 5, 2009

(51) Int. Cl.
*H01Q 3/26* (2006.01)
*H01Q 3/00* (2006.01)

(52) U.S. Cl. ..... 342/377; 342/368

(58) Field of Classification Search ..... 342/368–377
See application file for complete search history.

(56) References Cited

U.S. PATENT DOCUMENTS

| | | | | |
|---|---|---|---|---|
| 5,955,991 | A * | 9/1999 | Kawakubo | 342/374 |
| 6,590,532 | B1 * | 7/2003 | Ogawa et al. | 342/372 |
| 6,731,689 | B2 | 5/2004 | Dogan | |
| 6,795,392 | B1 * | 9/2004 | Li et al. | 342/373 |
| 6,847,832 | B2 | 1/2005 | Wong et al. | |
| 6,937,189 | B2 | 8/2005 | Kim | |
| 7,013,165 | B2 | 3/2006 | Yoon et al. | |
| 7,039,370 | B2 | 5/2006 | Laroia et al. | |
| 7,239,893 | B2 | 7/2007 | Yang | |
| 7,312,750 | B2 | 12/2007 | Mao et al. | |
| 7,342,535 | B2 | 3/2008 | Ann et al. | |
| 7,450,659 | B2 | 11/2008 | Corredoura et al. | |
| 2005/0276347 | A1 | 12/2005 | Mujtaba et al. | |
| 2006/0012520 | A1 * | 1/2006 | Tsai et al. | 342/377 |
| 2006/0104382 | A1 | 5/2006 | Yang et al. | |
| 2006/0234645 | A1 | 10/2006 | Lin et al. | |
| 2006/0248429 | A1 | 11/2006 | Grandhi et al. | |
| 2007/0189412 | A1 | 8/2007 | Xia et al. | |
| 2007/0205943 | A1 * | 9/2007 | Nassiri-Toussi et al. | 342/377 |
| 2008/0101493 | A1 | 5/2008 | Niu et al. | |
| 2008/0108390 | A1 | 5/2008 | Yoon et al. | |

(Continued)

FOREIGN PATENT DOCUMENTS

| | | |
|---|---|---|
| JP | 2004140642 | 5/2004 |

OTHER PUBLICATIONS

J. De Los Santos, MEMS-Based Microwave Circuits and Systems, Introduction to Microelectromechanical (MEM) Microwave Systems, Artech House, p. 167-168 and 193, 1999.*

(Continued)

*Primary Examiner*—Thomas H Tarcza
*Assistant Examiner*—Fred H Mull
(74) *Attorney, Agent, or Firm*—Kenneth L. Sherman, Esq.; Michael Zarrabian, Esq.; Myers Andras Sherman LLP

(57) ABSTRACT

A method and system for analog beamforming for wireless communication is provided. Such analog beamforming involves performing channel sounding to obtain channel sounding information, determining statistical channel information based on the channel sounding information, and determining analog beamforming coefficients based on the statistical channel information, for analog beamforming communication over multiple antennas.

32 Claims, 5 Drawing Sheets

U.S. PATENT DOCUMENTS

| | | | |
|---|---|---|---|
| 2008/0134254 | A1 | 6/2008 | Xia et al. |
| 2008/0144751 | A1 | 6/2008 | Xia et al. |
| 2008/0204319 | A1 | 8/2008 | Niu et al. |
| 2009/0033555 | A1 | 2/2009 | Niu et al. |
| 2009/0058724 | A1 | 3/2009 | Xia et al. |
| 2009/0121935 | A1 | 5/2009 | Xia et al. |

OTHER PUBLICATIONS

S. Furrer et al., Bounds on the ergodic capacity of training-based multiple-antenna systems, International Symposium on Information Theory, p. 780-784, Sept 2005.*

Hansen, R.C., "Phased Array Antennas," John Wiley and Sons, New York, 1998.

Coffey, S. et. al, "Joint Proposal: High throughput extension to the 802.11 Standard: PHY", doc.: IEEE 802.11-05/1102r4, draft proposal, Jan. 2006.

Niu, H., and Ngo, C., "Beamforming for Space-Time Coded IEEE 802.11n System with Known Fading Correlations," in Proceeding of 39th Asilomar Conference on Signals, Systems and Computers, Pacific Grove, CA, Nov. 2005.

Van Veen B.D., Buckley, K.M., "Beamforming: A versatile approach to spatial filtering," ASSP Magazine, IEEE, vol. 5, Iss. 2, Apr. 1988, pp. 4-24.

Butler, J. and Lowe, R., "Beam-Forming Matrix Simplifies Design of Electronically Scanned Antennas," Electronic Design, pp. 170-173, Apr. 12, 1961.

802.11 Working Group of the 802 Committee, "Draft Amendment to Standard for Information Technology-Telecommunications and information exchange between systems-Local and metropolitan area networks-Specific Enhancements for Higher Throughput," IEEE P802.11n/D1.0 (Mar. 2006). pp. 1-335.

G. Stuber, J. Barry, S. McLaughlin, Y. Li, M. Ingram and T. Pratt, "Broadband MIMO-OFDM wireless communications," Proceedings of the IEEE, vol. 92, No. 2, pp. 271-294, Feb. 2004.

U.S. Non-Final Office Action for U.S. Appl. No. 11/881,978 mailed Jul. 25, 2008.

U.S. Non-Final Office Action for U.S. Appl. No. 11/881,978 mailed Jan. 2, 2009.

High-Definition Multimedia (HDMI) Specifications version 1.2, Aug. 22, 2005, pp. 1-214.

IEEE Std 802.15.3, "Wireless Medium Access Control (MAC) and Physical Layer (PHY) Specifications for High Rate Wireless Personal Area Networks (WPANs)," 2003, pp. 1-324.

WirelessHD Specification draft version 0.7, WirelessHD consortium, Feb. 2007.

Scintera Networks, Advanced Signal Processing Platform, Sep. 2003.

Razavi, B., "Challenges in Portable RF Transceiver Design." Circuits & Devices, 8755-3996/96, IEEE, Sep. 1996, pp. 12- 24. United States.

Buzzi, S. et al., "Performance of iterative data detection and channel estimation for single-antenna and multiple-antennas wireless communications," IEEE Transactions on Vehicular Technology, vol. 53(4), pp. 1085-1104, Jul. 2004. United States.

U.S. Non-Final Office Action for U.S. Appl. No. 11/706,942 mailed Oct. 15, 2008.

U.S. Non-Final Office Action for U.S. Appl. No. 11/899,286 mailed Sep. 24, 2009.

U.S. Notice of Allowance for U.S. Appl. No. 11/881,978 mailed Sep. 15, 2009.

* cited by examiner

100

100

160

200

250

METHOD AND SYSTEM FOR ANALOG BEAMFORMING IN WIRELESS COMMUNICATIONS

FIELD OF THE INVENTION

The present invention relates to wireless communications, and in particular, to beamforming transmissions in wireless channels.

BACKGROUND OF THE INVENTION

With the proliferation of high quality video, an increasing number of electronic devices (e.g., consumer electronics (CE) devices) utilize high-definition (HD) video. Conventionally, most systems compress HD content, which can be around 1 gigabits per second (Gbps) in bandwidth, to a fraction of its size to allow for transmission between devices. However, with each compression and subsequent decompression of the signal, some data can be lost and the picture quality can be degraded.

The existing High-Definition Multimedia Interface (HDMI) specification allows for transfer of uncompressed HD signals between devices via a cable. While consumer electronics makers are beginning to offer HDMI-compatible equipment, there is not yet a suitable wireless (e.g., radio frequency (RF)) technology that is capable of transmitting uncompressed HD signals. For example, conventional wireless local area networks (LAN) and similar technologies can suffer interference issues when wireless stations do not have sufficient bandwidth to carry uncompressed HD signals.

Antenna array beamforming has been used to increase bandwidth and signal quality (high directional antenna gain), and to extend communication range by steering the transmitted signal in a narrow direction. However, conventional digital antenna array beamforming is an expensive process, requiring multiple expensive radio frequency chains connected to multiple antennas.

BRIEF SUMMARY OF THE INVENTION

The present invention provides a method and system for analog beamforming for wireless communication. In one embodiment, such analog beamforming involves performing channel sounding to obtain channel sounding information, determining statistical channel information based on the channel sounding information, and determining analog beamforming coefficients based on the statistical channel information, for analog beamforming communication over multiple antennas.

In one implementation, direction-of-arrival and direction-of-departure information is determined from the statistical channel information. Determining analog beamforming coefficients includes determining transmitter power level coefficients and phase coefficients from the direction-of-departure information. In addition, determining analog beamforming coefficients involves determining receiver power level coefficients and phase coefficients from direction-of-arrival information. A transmitter station performs analog beamforming based on the transmit power level and phase coefficients, and a receiver station performs analog beamforming based on the receiver power level and phase coefficients.

These and other features, aspects and advantages of the present invention will become understood with reference to the following description, appended claims and accompanying figures.

DETAILED DESCRIPTION OF THE INVENTION

The present invention provides a method and system for analog beamforming in wireless communications. In one embodiment, the present invention provides a method and system for analog beamforming using statistical channel knowledge for wireless communications between a transmit station and a receive station. An analog domain antenna array beamforming process allows the transmit station and the receive station to perform analog beamforming based on statistical channel information providing direction-of-arrival and direction-of-departure information. The transmit station performs analog beamforming based on direction-of-departure information, and the receive station performs analog beamforming based on direction-of-arrival information.

In one example implementation described below, such analog beamforming is utilized for transmission of uncompressed video signals (e.g., uncompressed HD video content), in a 60 GHz frequency band such as in WirelessHD (WiHD) applications. WiHD is an industry-led effort to define a wireless digital network interface specification for wireless HD digital signal transmission on the 60 GHz frequency band, (e.g., for CE devices).

For wireless transmission of uncompressed HD video signals due to large bandwidth and low spectrum efficiency, reliable transmission of a single uncompressed video stream is sufficient. Therefore, analog beamforming using an RF chain for multiple antennas in an array (as opposed to an RF chain per antenna in digital beamforming), reduces the RF chain cost while maintaining an antenna array gain. Since the transmission frequency is high, the transmitter antenna spacing is very small. Therefore, in transmitter fabrication, multiple antennas can be mounted in one chip. Using such analog beamforming, a large array gain can be achieved to improve the video transmission quality.

Figure 1:
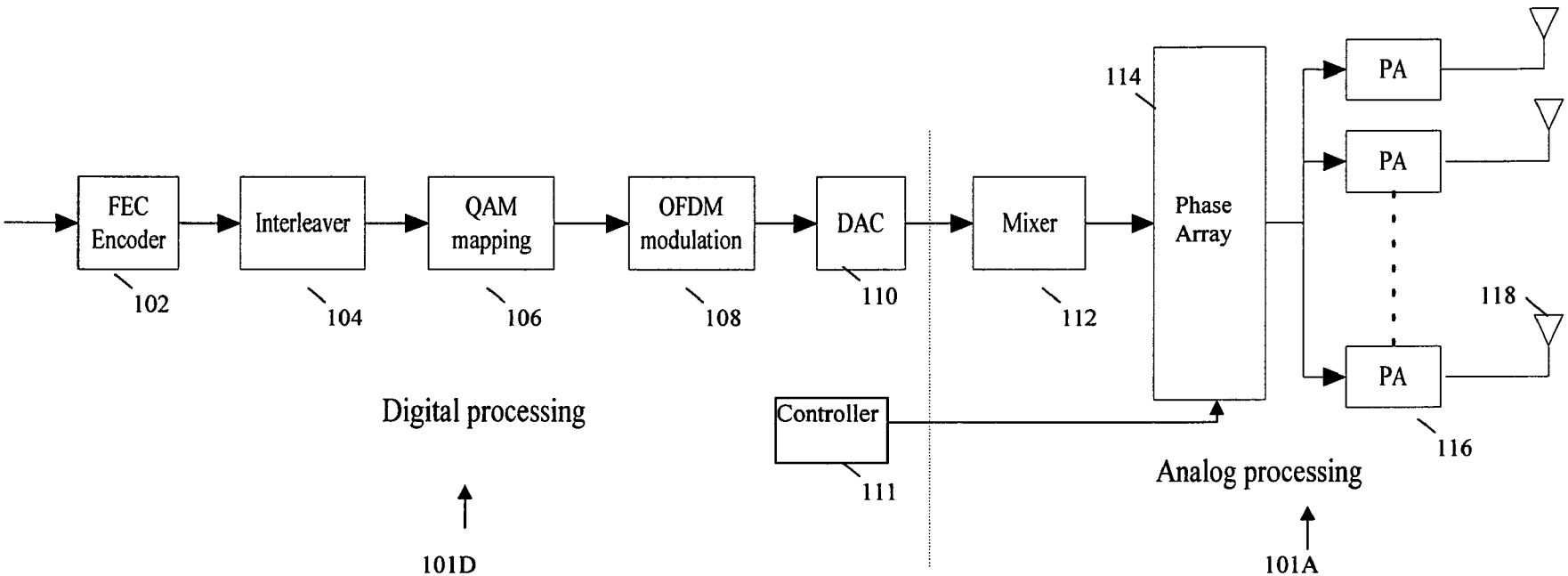
FIG. 1 shows a block diagram of an orthogonal frequency division multiplexing (OFDM) wireless transmitter that implements an analog beamforming method, according to an embodiment of the present invention.

FIG. 1 shows a block diagram of a wireless station 100 implementing analog beamforming using statistical (e.g., estimated) channel information, according to an embodiment of the present invention. Such a wireless station is useful in wireless transmission of uncompressed video signals such as in WiHD applications. The wireless station 100 utilizes OFDM, and includes a digital processing section 101D and an analog processing section 101A.

The digital processing section 101D has one RF chain including a forward error correction (FEC) encoder 102, an interleaver 104, a Quadrature Amplitude Modulation (QAM)

mapper 106, an OFDM modulator 108, a digital-to-analog converter (DAC) 110 and a controller 111. The analog section 101A includes a mixer 112, a phase (phase shift) array 114, and an array of multiple power amplifiers (PAs) 116 corresponding to multiple antennas 118. The controller 111 provides transmit phase and amplitude coefficients to the phase and amplifier arrays 114 and 116, respectively, for transmit analog beamforming.

The FEC encoder 102 encodes an input bit stream, and the interleaver 104 interleaves the encoded bit using block interleaving. Then, the QAM mapper 106 maps the interleaved bits to symbols using a Gray mapping rule. The OFDM modulator 108 performs OFDM modulation on the symbols, and the DAC 110 generates a baseband signal from OFDM modulated symbols.

In the analog processing section 101A, the analog signal from the DAC 110 is provided to the mixer 112 which modulates the analog signal from baseband up to the transmission frequency (e.g., 60 GHz). The modulated signal is then input to the phase array 114, which in conjunction with the controller 111, applies a coefficient vector $W_T$ (i.e., weighting coefficients) thereto for transmission beamforming. The weighted signals are then amplified via the PA116 for transmission through an array of N transmit antennas 118.

Figure 2:
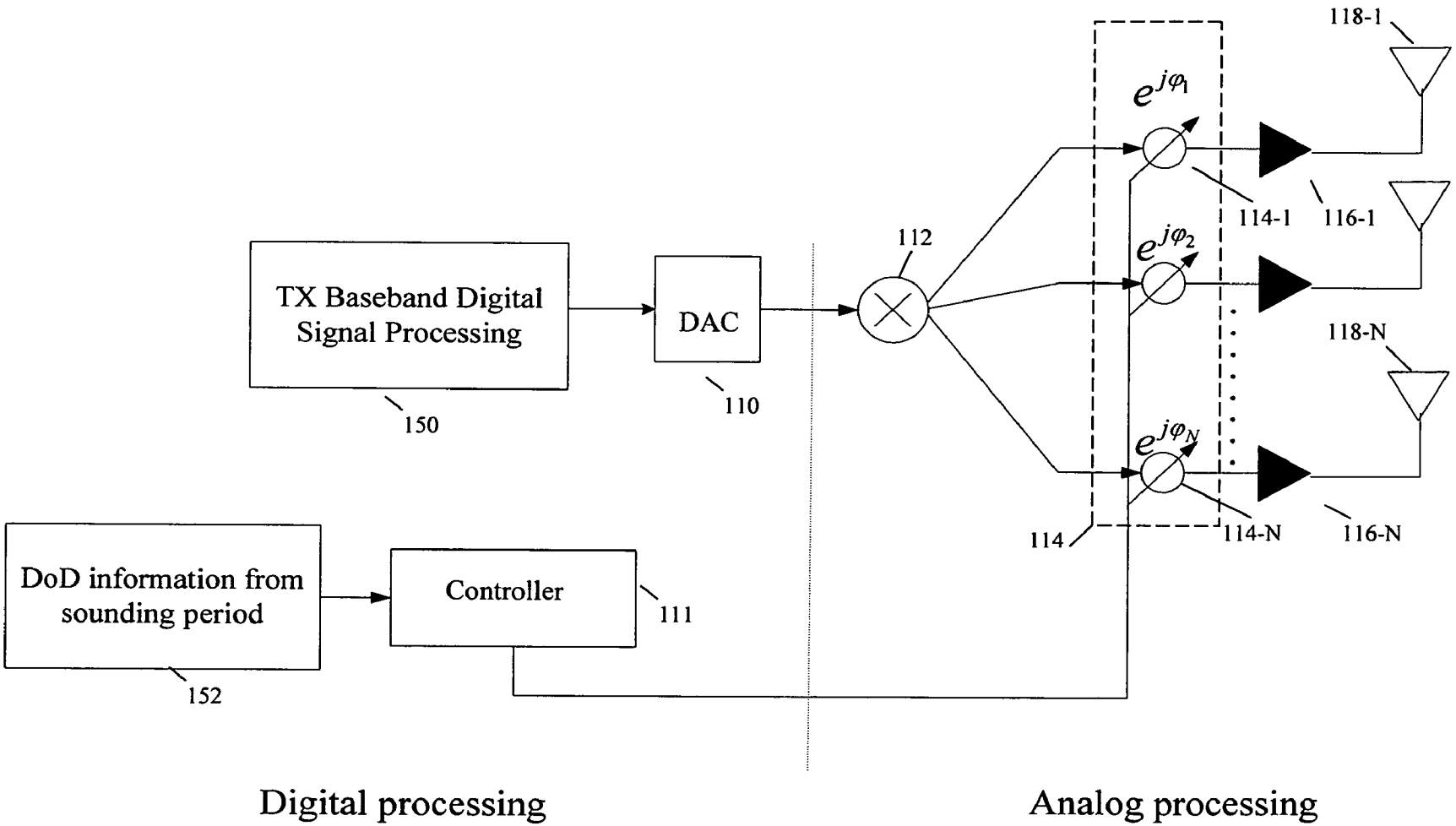
FIG. 2 shows a functional diagram of the analog transmit beamforming method of transmitter of FIG. 1, according to an embodiment of the present invention.

FIG. 2 shows an example functional diagram of the analog transmit beamforming method of the wireless station of FIG. 1. The FEC encoder 102, the interleaver 104, the QAM mapper 106, and the OFDM modulator 108 in FIG. 1, collectively perform transmission baseband digital signal processing, shown as a processing module 150 in FIG. 2.

The digital output of the processing module 150 is then converted to an analog signal by the DAC 110, and provided to the mixer 112 which modulates the analog signal to a 60 GHz transmission frequency. The phase array 114, in conjunction with the controller 111, applies the coefficient vector $W_T$ to the modulated signal for transmit beamforming. As such, the analog data signals from the DAC 110 are transmitted over a channel via transmit antennas 118 by steering and amplifying the analog data signals using the transmit beamforming vector $W_T$.

The transmit beamforming coefficient vector $W_T$ comprises elements $e^{j\Phi}{}_1, \ldots, e^{j\Phi}{}_N$, wherein $\phi_1, \ldots, \phi_N$ are beamforming phase coefficients that are calculated by the controller 111 and controlled digitally at the baseband. Preferably, the coefficient vector $W_T$ is an optimal coefficient. A direction of departure (DoD) function 152 estimates the direction of departure information $\theta_T$ based on the statistical channel information obtained during a channel sounding period.

A channel sounding period includes a training period, in which a sounding packet exchange can be implemented by generating a training request (TRQ) specifying a number of training fields, and transmitting a TRQ from a transmit station (initiator) having multiple antennas to a receive station (responder) over a wireless channel, wherein the TRQ specifies the number of training fields based on the number of transmit antennas. The receive station then transmits a sounding packet to the transmit station, wherein the sounding packet includes multiple training fields corresponding to the number of training fields specified in the TRQ. Based on the sounding packet, the wireless station transmits a beamforming transmission to the receive station to enable wireless data communication therebetween. This provides a sounding packet format and an exchange protocol for wireless beamforming using statistical channel information.

Specifically, the controller 111 determines a transmit channel correlation matrix $R_T$ based on the DoD information $\theta_T$ from the channel sounding information. Then, the transmit phase coefficients $\phi_1, \ldots, \phi_N$ and amplitude (power lever) coefficients $[\alpha_1, \ldots, \alpha_N]$ are determined based on the transmit channel correlation matrix $R_T$ (detailed further below), wherein the transmit beamforming coefficient vector $W_T = [\alpha_1 e^{j\phi_1}, \ldots, \alpha_N e^{j\phi_N}]$, is related only to the transmit correlation matrix $R_T$.

The coefficient vector $W_T$ *includes* complex numbers as phase (weighting) coefficients, wherein the phase coefficient $\phi_1, \ldots, \phi_N$ are applied to the frequency band signals by N phase array elements 114-1, . . . , 114-N, respectively. Then, the amplitude coefficients $[\alpha_1, \ldots, \alpha_N]$ are applied to the phase shifted signal (i.e., the analog beamformed signal) from the phase array elements 114-1, . . . , 114-N, by N power amplifiers 116-1, . . . , 116-N, respectively. The signals amplified by the amplifiers 116-1, . . . , 116-N are wirelessly transmitted to a receive station via the N antennas 118-1, . . . , 118-N.

Figure 3:
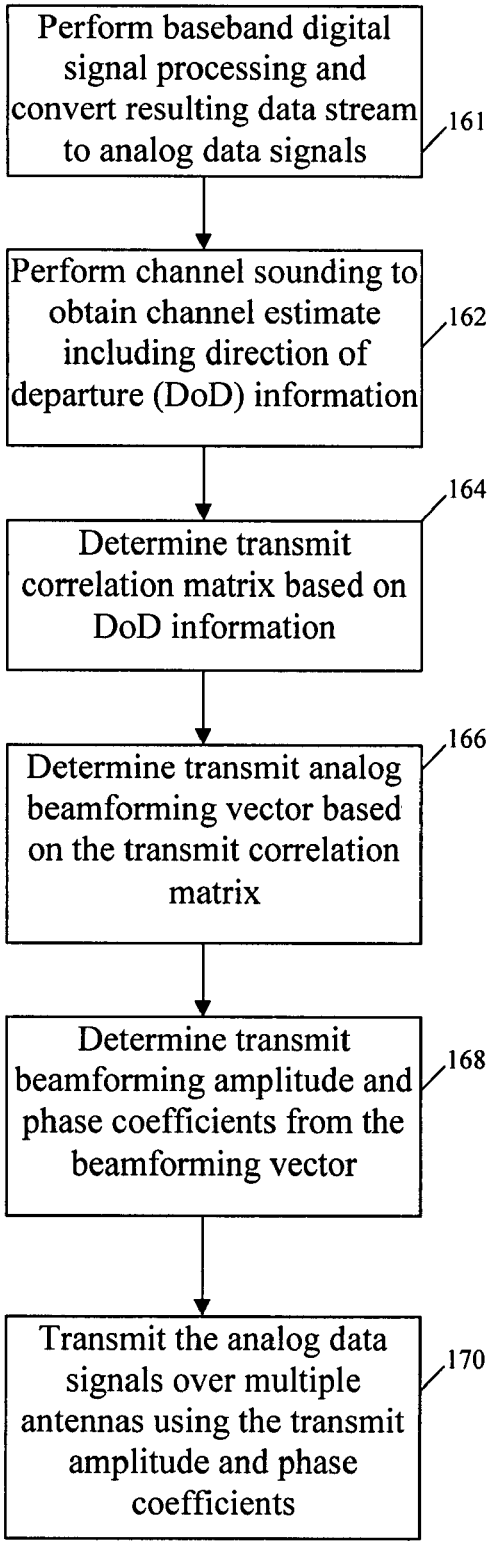
FIG. 3 shows a flowchart of the steps of an analog transmit beamforming process, according to an embodiment of the present invention.

FIG. 3 shows a flowchart of the steps of the example transmit analog beamforming process 160 implemented in FIG. 2, including the steps of:

Step 161: Perform baseband digital signal processing and convert the resulting data stream to analog data signals.

Step 162: Perform channel sounding to obtain a channel estimate including direction of departure (DoD) information $\theta_T$ based on the sounding period information.

Step 164: Determine the transmit channel correlation matrix $R_T$ based on the DoD information $\theta_T$.

Step 166: Determine the transmitter beamforming vector $W_T = [\alpha_1 e^{j\phi_1}, \ldots, \alpha_N e^{j\phi_N}]$ based on the correlation matrix $R_T$.

Step 168: Determine the transmit beamforming phase coefficients $\phi_1, \ldots, \phi_N$ and amplitude coefficients $[\alpha_1, \ldots, \alpha_N]$ from the beamforming vector $W_T = [\alpha_1 e^{j\phi_1}, \ldots, \alpha_N e^{j\phi_N}]$.

Step 170: Transmit the analog signals to a receive station from a transmit station over transmitter antennas, by steering and amplifying the analog data signals using the phase and amplitude coefficients, respectively. The signals are transmitted via a wireless communication medium (e.g., over RF communication channels).

Figure 4:
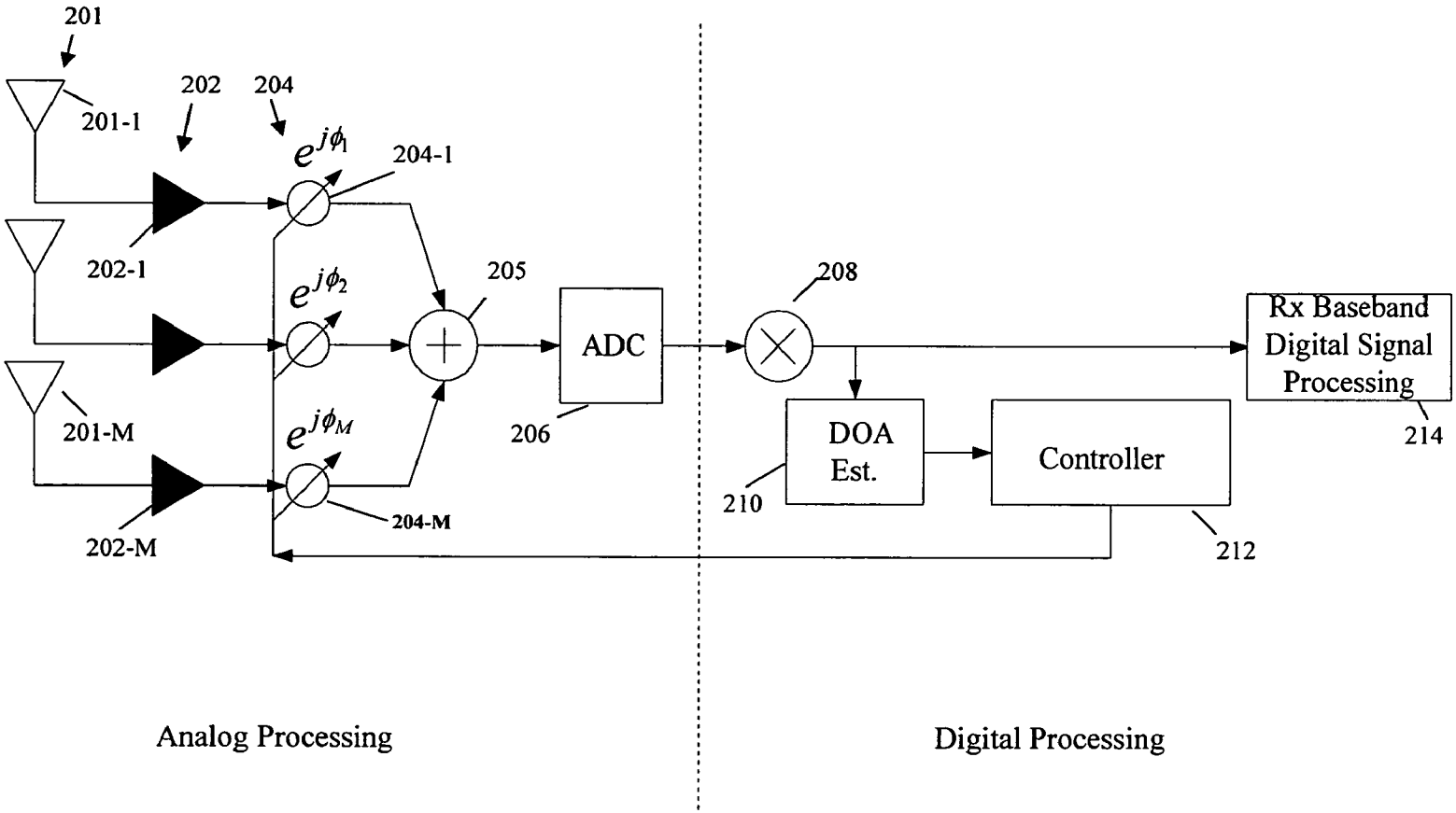
FIG. 4 shows a functional diagram of an OFDM wireless station that implements receive analog beamforming, corresponding to the transmit analog beamforming in the wireless station of FIG. 2, according to an embodiment of the present invention.

FIG. 4 shows a functional diagram of an OFDM wireless station 200 that implements receive analog beamforming, corresponding to the transmit analog beamforming in wireless station 100, according to an embodiment of the present invention. The station 200 includes an antenna array 201 (including M receive antennas 201-1, . . . , 201-M), a power amplifier array 202 (including M amplifiers 202-1, . . . , 202-M), a phase shift array 204 (including M phase elements 204-1, . . . , 204-M), a combiner function 205 which coherently combines the outputs of the phase shift array 204, an analog-to-digital converter (ADC) 206, a mixer function 208 which down-converts the RF signal from the ADC 206 to baseband for digital signal processing, a direction of arrival (DoA) estimation function 210, a baseband processing function 214 and a controller 212 that provides receive phase and amplitude coefficients to the amplifier and phase shift arrays 202 and 204, respectively, for receive analog beamforming.

In operation, the transmitted signals are received by the antenna array 201, and amplified by the amplifier array 202 using receive amplitude (power level) coefficients $\beta_1, \ldots, \beta_M$. The amplified signals are processed in the phase shift array 204 using the receive phase coefficients $\Phi_1, \ldots, \Phi_M$. The receive amplitude and phase coefficients are determined by the controller 212, and together form a receive beamforming coefficient vector $W_R = [\beta_1 e^{j\Phi_1}, \ldots, \beta_N e^{j\Phi_M}]$ which comprises elements $e^{j\Phi}{}_1, \ldots, e^{j\Phi}{}_M$. The output of the phase elements

204-1, . . . , 204-M of the phase shift array 204, representing an analog beamformed signal, is provided to the combiner function 205 which combines them together for high signal power.

The output of the combiner function module 205 (i.e., a combined output of the receive analog beamformed signal) is converted to a digital signal by the ADC 206, and provided to the mixer function 208 for conversion to baseband. The baseband output of the mixer function 208 is provided to the baseband digital signal processor 214 for conventional receiver processing.

The output of the mixer function 208 is also provided to the DoA estimator 210 to estimate the DoA information $\theta_R$ (i.e., the channel statistical information) from the sounding information (similar to that described above in relation to the station 100). The controller 212 uses the DoA information $\theta_R$ to determine a receive channel correlation matrix $R_R$. Then, the receive phase coefficients $\Phi_1, \ldots, \Phi_M$ are determined based on the receive channel correlation matrix $R_R$ (detailed further below). As such, the receive beamforming coefficient vector $W_R$ is related only to the receive correlation matrix $R_R$.

Figure 5:
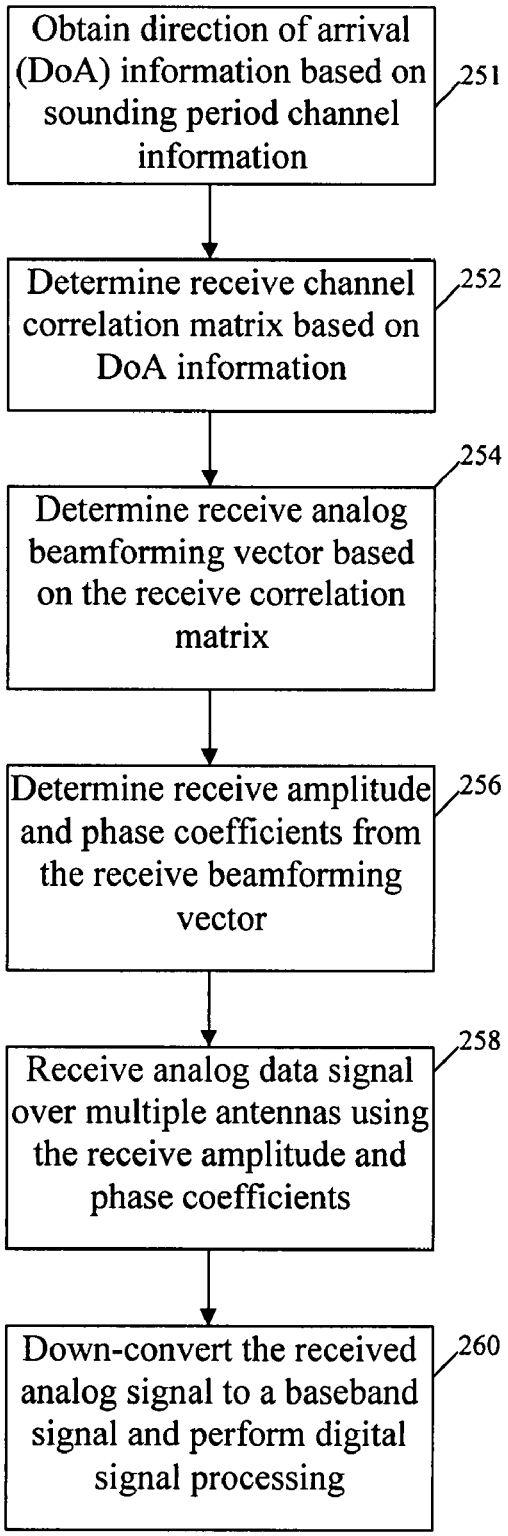
FIG. 5 shows a flowchart of the steps of an analog receive beamforming process, according to an embodiment of the present invention.

FIG. 5 shows a flowchart of the steps of the example receive analog beamforming process 250 implemented in the station 200 of FIG. 2, including the steps of:

Step 251: Obtain the DoA information $\theta_R$ based on the sounding period channel estimation information.

Step 252: Determine the receive channel correlation matrix $R_R$ based on the DoA information $\theta_R$.

Step 254: Determine the receive beamforming vector $W_R=[\beta_1 e^{j\Phi_1}, \ldots, \beta_N e^{j\Phi_M}]$ based on the receive correlation matrix $R_R$.

Step 256: Determine the transmit beamforming amplitude coefficients $\beta_1, \ldots, \beta_M$ and phase coefficients $\phi_1, \ldots, \phi_N$ from the receive beamforming vector.

Step 258: Receive the analog signals using the receive amplitude and phase coefficients.

Step 260: The received analog signal is down-converted to a baseband signal for digital signal processing.

As noted, the transmitter beamforming coefficient vector $W_T$ is related only to the channel correlation matrix $R_T$, and the receiver beamforming coefficient vector $W_R$ is related only to the channel correlation matrix $R_R$. A channel matrix H can be modeled as:

$$H=R_R^{1/2}H_W R_T^{1/2},$$

wherein elements of matrix $H_W$ are independent and identically distributed (i.i.d.) complex Gaussian distributed, with a zero mean and unit covariance, and wherein:

$$[R_T]m,$$

$$n = \exp(-j2\pi(m-n)\Delta_T\cos(\theta_T))\cdot\exp\left(-\frac{1}{2}[2\pi(m-n)\Delta_T\sin(\theta_T)\sigma_T]^2\right)$$

$$[R_R]m,\ n = \exp(-j2\pi(n-m)\Delta_R\cos(\theta_R))\cdot\exp\left(-\frac{1}{2}[2\pi(n-m)\Delta_R\sin(\theta_R)\sigma_R]^2\right)$$

where $\theta_T$, $\theta_R$ are the angle of departure from the transmitter and the angle of arrival to the receiver, $\sigma_T$,$\sigma_R$ are angle spreads at the transmitter and the receiver, $\Delta_T$,$\Delta_R$ are the distance between the adjacent antenna elements in terms of carrier wavelength:

wherein m and n are the element index in each matrix.

The transmit beamforming vector $W_T=e^{j\Phi}{}_1, \ldots, e^{j\Phi}{}_N$ is determined based on the transmit channel correlation matrix $R_T$ as follows. The correlation matrix $R_T$ is used to calculate $U_T$ which is a unitary vector that comprises right singular vectors of $R_T$, such that:

$R_T=U_T\Lambda_T U_T^*$, wherein * means conjugate transpose.

The transmit beamforming vector $W_T$ is determined as $W_T=U_T$.

Similarly, the receive beamforming vector $W_R=[\beta_1 e^{j\Phi_1}, \ldots, \beta_N e^{j\Phi_M}]$ is determined based on the receive channel correlation matrix $R_R$ as follows. The receive channel correlation matrix $R_R$ is used to calculate $U_R$ which is a unitary vector that comprises right singular vectors of $R_R$, such that:

$$R_R=U_R\Lambda_R U_R^*.$$

Then, the receiver beamforming vector $W_R$ is determined as $W_R=U_R$.

An analog domain antenna array beamforming process based on the channel statistical information direction-of-arrival and direction-of-departure information provides simplified and efficient wireless communication, compared to digital beamforming such as eigen-based beamforming techniques which typically require multiple RF chains corresponding to multiple antennas.

As is known to those skilled in the art, the aforementioned example architectures described above, according to the present invention, can be implemented in many ways, such as program instructions for execution by a processor, as logic circuits, as an application specific integrated circuit, as firmware, etc. The present invention has been described in considerable detail with reference to certain preferred versions thereof; however, other versions are possible. Therefore, the spirit and scope of the appended claims should not be limited to the description of the preferred versions contained herein.

What is claimed is:

1. A method of analog beamforming for wireless communication, comprising:

using a single RF chain in connection with performing digital signal processing, comprising:

at a transmitter:

performing channel sounding, only using direction of departure (DoD) estimation, to obtain channel sounding information including estimated DoD information;

at a receiver:

determining statistical channel information, only using direction of arrival (DoA) estimation, based on the channel sounding information obtained using only DoD estimation at the transmitter; and determining analog beamforming coefficients based on the statistical channel information; and performing analog beamforming communication over multiple antennas using the beamforming coefficients.

2. The method of claim 1 wherein determining analog beamforming coefficients based on the statistical channel information further includes determining power level coefficients based on the statistical channel information for analog beamforming over multiple antennas.

3. The method of claim 1 wherein determining analog beamforming coefficients based on the statistical channel information further includes determining phase coefficients based on the statistical channel information for analog beamforming over multiple antennas.

4. The method of claim 3 wherein determining analog beamforming coefficients based on the statistical channel information further includes:

determining power level coefficients based on the statistical channel information;

determining phase coefficients based on the statistical channel information; and determining analog beamforming coefficients based on the power level coefficients and the phase coefficients, for analog beamforming over multiple antennas.

5. The method of claim 4 wherein determining statistical channel information includes estimating the channel based on the channel sounding information.

6. The method of claim 5 wherein determining analog beamforming coefficients further includes determining transmit analog beamforming coefficients based on the DoD information.

7. The method of claim 6 wherein determining analog beamforming coefficients further includes determining receive analog beamforming coefficients based on the direction-of-arrival information.

8. The method of claim 7 wherein determining analog beamforming coefficients further includes:

determining a transmit correlation matrix based on the statistical channel information; and determining transmit analog beamforming coefficients based on the transmit correlation matrix.

9. The method of claim 8 wherein determining the transmit correlation matrix based on the statistical channel information further includes:

estimating the DoD information from the channel sounding information; and determining the transmit correlation matrix based on the DoD information.

10. The method of claim 9 wherein determining analog beamforming coefficients further includes:

determining a receive correlation matrix based on the statistical channel information; and determining the receive analog beamforming coefficients based on the receive correlation matrix.

11. The method of claim 10 wherein determining the receive correlation matrix based on the statistical channel information further includes:

estimating the DoA information from the channel sounding information; and determining the receive correlation matrix based on the DoA information.

12. The method of claim 11 wherein:

determining the analog beamforming coefficients based on the statistical channel information includes determining the power level coefficients based on the statistical channel information, determining phase coefficients based on the statistical channel information; and communicating analog signals over a wireless channel by amplifying and steering the analog signals using the power level coefficients and the phase coefficients, respectively.

13. The method of claim 12 wherein:

determining analog beamforming coefficients further includes determining analog transmit power levels and phase coefficients based on direction-of-departure information from the channel statistical information, and communicating uncompressed high definition video signals over a wireless channel includes transmitting analog signals over multiple antennas by steering and amplifying the analog signals using the transmit phase coefficients and the transmit power level coefficients, respectively, using orthogonal frequency division multiplexing in a 60 GHz frequency band.

14. The method of claim 12 wherein:

determining analog beamforming coefficients further includes determining analog receive power level and phase coefficients based on direction-of-arrival information from the channel statistical information; and communicating uncompressed high definition video signals over a wireless channel includes receiving analog signals over multiple antennas by amplifying and steering the analog signals using the receive power level coefficients and the receive phase coefficients, respectively, using orthogonal frequency division multiplexing in a 60 GHz frequency band.

15. The method of claim 11, wherein the single RF chain includes a single encoder and a single modulator.

16. The method of claim 10 wherein determining the analog beamforming coefficients further includes:

determining the receive beamforming phase coefficients based on the receive correlation matrix; and determining a receive analog beamforming vector based on the receive beamforming phase coefficients.

17. The method of claim 10 wherein determining the analog beamforming coefficients further includes:

determining the receive beamforming power level coefficients based on the receive correlation matrix; and determining a receive analog beamforming vector based on the receive beamforming power level coefficients.

18. The method of claim 8 wherein determining analog beamforming coefficients further includes:

determining the transmit beamforming phase coefficients based on the transmit correlation matrix; and determining a transmit analog beamforming vector based on the transmit beamforming phase coefficients.

19. The method of claim 8 wherein determining analog beamforming coefficients further includes:

determining the transmit beamforming power level coefficients based on the transmit correlation matrix; and determining a transmit analog beamforming vector based on the transmit beamforming power level coefficients.

20. A wireless station for analog beamforming communication, comprising:

a single RF chain coupled with a digital signal processing portion, comprising:

at a receiver:

a direction of arrival (DoA) estimator configured for determining statistical channel information, only using DoA estimation, based on channel sounding information obtained using only direction of departure (DoD) estimation at a transmitter; and a controller configured for determining analog beamforming coefficients based on the statistical channel information, a communication module configured for analog beamforming communication over multiple antennas using the beamforming coefficients.

21. The wireless station of claim 20 wherein the controller is configured for determining analog beamforming power level coefficients based on the statistical channel information for analog beamforming over multiple antennas.

22. The wireless station of claim 21 wherein the controller is configured for determining analog beamforming power level coefficients and phase coefficients based on the statistical channel information, and determining analog beamforming coefficients based on the power level coefficients and the phase coefficients, for analog beamforming over multiple antennas.

23. The wireless station of claim 22 wherein the estimator is configured for determining statistical channel information by estimating the channel based on the channel sounding information.

24. The wireless station of claim 20 wherein the controller is configured for determining analog beamforming phase coefficients based on the statistical channel information for analog beamforming over multiple antennas.

25. The wireless station of claim 20 wherein the controller is further configured for determining analog beamforming coefficients based on DoA information.

26. A wireless transmitter for analog beamforming communication, comprising:

a single RF chain coupled with a digital signal processing portion, comprising:

an estimator configured for determining statistical channel information, only using direction of arrival (DoA) in estimation, based on channel sounding information obtained using only direction of departure (DoD) estimation;

a controller configured for determining analog beamforming phase and power level coefficients based on the statistical channel information, for analog beamforming transmission over an antenna array using a single RF chain; and a phase shifter array and an amplifier array, corresponding to the antenna array, the phase shifter array configured for steering analog data signals based on the phase coefficients to generate beamformed signals, and the amplifier array configured for amplifying the beamformed signals based on the power level coefficients, for transmission over the antenna array.

27. The wireless transmitter of claim 26 wherein the controller is configured for determining the phase and power level coefficients based on the DoD information.

28. The wireless transmitter of claim 27 wherein the controller is configured for determining a transmit correlation matrix based on the DoD information, and determining the phase and power level coefficients based on the transmit correlation matrix.

29. A wireless receiver for analog beamforming communication, comprising:

a single RF chain coupled with a digital signal processing portion, comprising:

an estimator configured for determining statistical channel information based on channel sounding information, only using direction of arrival (DoA) estimation, based on channel sounding information obtained using only direction of departure (DoD) estimation at a transmitter;

a controller configured for determining analog beamforming phase and power level coefficients based on the statistical channel information, for analog beamforming reception over an antenna array using a single RF chain; and an amplifier array and a phase shifter array, corresponding to the antenna array for receiving analog signals, the amplifier array configured for amplifying the received signals based on the power level coefficients, and the phase shifter array configured for steering analog data signals based on the phase coefficients to generate beamformed signals.

30. The wireless receiver of claim 29 wherein the controller is configured for determining the phase and power level coefficients based on the DoA information.

31. The wireless receiver of claim 29 wherein the controller is configured for determining a receive correlation matrix based on the DoA information, and determining the phase and power level coefficients based on the receive correlation matrix.

32. A method of analog beamforming for wireless communication, comprising:

using a single RF chain in connection with performing digital signal processing, comprising:

performing channel sounding to obtain channel sounding information;

determining statistical channel information comprising:

determining transmit analog beamforming coefficients comprising:

estimating the direction-of-departure (DoD) information from the channel sounding information; and determining a transmit correlation matrix based on the DoD information; and determining the transmit analog beamforming coefficients based on the transmit correlation matrix;

determining receive analog beamforming coefficients comprising:

estimating direction-of-arrival (DoA) information from the channel sounding information;

determining a receive correlation matrix based on the DoA information; and determining the receive analog beamforming coefficients based on the receive correlation matrix; and determining analog beamforming coefficients based on the statistical channel information; and performing analog beamforming communication over multiple antennas using the analog beamforming coefficients.

* * * * *